United States Patent [19]

Pykälä

[11] 4,057,279

[45] Nov. 8, 1977

[54] CENTER LIFTING DEVICE

[75] Inventor: Timo Pykälä, Espoo, Finland

[73] Assignee: Oy Finnlines Ltd., Helsinki, Finland

[21] Appl. No.: 724,250

[22] Filed: Sept. 17, 1976

[30] Foreign Application Priority Data

Sept. 29, 1975 Finland ..... 752712

[51] Int. Cl.[2] ..... B66C 1/46

[52] U.S. Cl. ..... 294/93

[58] Field of Search ..... 294/63 A, 86.14, 86.15, 294/86.2, 86.21, 86.24, 93–98, 99 R, 109, 110 R, 127, 130; 214/DIG. 3, DIG. 4

[56] References Cited

U.S. PATENT DOCUMENTS

| | | | |
|---|---|---|---|
| 819,359 | 5/1906 | Markland | 294/97 |
| 1,720,732 | 7/1929 | Jongedyk | 294/97 |
| 2,701,736 | 2/1955 | Heppenstall | 294/110 R X |
| 3,088,769 | 5/1963 | Richardson | 294/110 R X |
| 3,892,437 | 7/1975 | Markinen | 294/93 |

FOREIGN PATENT DOCUMENTS

| | | | |
|---|---|---|---|
| 496,763 | 11/1950 | Belgium | 294/93 |
| 1,482,974 | 6/1967 | France | 294/94 |

*Primary Examiner*—Johnny D. Cherry

*Attorney, Agent, or Firm*—Lewis H. Eslinger

[57] ABSTRACT

A center lifting device for lifting and transferring rolls of material, such as paper rolls and the like, having two parts, one inside the other, which can be moved over a limited distance in relation to each other and fitted partly into the hollow in the roll of material, whereby the upper end of the inner part can be attached to a lifting device. The lower end of the outer part has a gripping member thereon, which expands and contracts under the effect of relative movement of the parts, for attaching the center lifting device to the hollow in the roll of material. The upper end of the outer part has a bolt device for preventing the inner part from rising in relation to the outer part. A driving member is fitted resiliently to the upper end of the outer part and can be forced axially downwards and has a member which works in conjunction with the bolt device for releasing the bolt device from the inner part when the driving member is forced downwards, and a locking member, which has been fitted to retain the driving member at its lower position and which works in conjunction with the inner part in such a manner that the inner part releases the locking member from the driving member when the inner part moves upwards in relation to the outer part at the initial stage of the lift.

10 Claims, 5 Drawing Figures

B – B

B – B

CENTER LIFTING DEVICE

BACKGROUND OF THE INVENTION

The present invention relates to a center lifting device for lifting and transferring rolls of material, such as paper rolls and the like, comprising two parts, one inside the other, which can be moved over a limited distance in relation to each other and fitted partly into the hollow or care of the roll of the material. The upper end of the inner part is attached to the lifting device and the lower end of the outer part includes a gripping member which expands and contracts under the effect of movement between the parts, for attaching the center lifting device to the hollow in the roll of the material. The outer part has at its upper end a bolt device for preventing the inner part from rising in relation to the outer part.

Previously known is a conveying device for conveying paper rolls, comprising a bar-like inner part attached to the lifting device and a surrounding tubular outer part. The inner part is attached to the lifting device by means of lever arms, which are fitted to produce, during lifting, an axial movement between the inner and outer parts, whereby the conical piece at the lower end of the inner part rises along with the inner part and forces the turning bolts at the lower end of the outer part outwards to attach the conveying device to the socket in the center of the paper roll. After conveying, the paper roll is lowered, whereby the inner part can descend in relation to the outer part and the conical piece at the lower end of the inner part no longer presses the turning bolts outwards. In order to detach the conveying device and to lift it out of the socket, the inner part must, however, be locked in relation to the outer part. This is achieved by means of a spring-actuated bolt device which, when released, pushes itself onto the inner part at the upper end of the outer part, thereby preventing it from rising in the outer part. On top of the bolt device there is a screwable lid which can be turned away from the front of the bolt device in order to release it and turned back in order to force the bolt device off the top of the inner part.

This known conveying device is very complicated and expensive. In addition, it has the disadvantage that it is difficult to make the turning bolts grip the socket firmly enough at the initial stage of the lifting, and the turning cover must also be opened manually at the end of the lift.

The object of the present invention is thus to provide a center lifting device of the type mentioned in the preamble, wherein the said drawbacks are eliminated. The center lifting device can be attached directly to the inner part without any lever arms; the center lifting device grips the socket so firmly even at the beginning that the gripping member at its lower end can be expanded to produce a sufficient friction force for lifting, and at the end of the lift the bolt device automatically locks the inner part in relation to the outer part so that the center lifting device can be lifted out of the socket.

SUMMARY OF THE INVENTION

According to the invention there is provided a central lifting device having a driving member fitted resiliently to the upper end of an outer part. The driving member is adapted to be forced axially downwards and has a member co-operating with a bolt device for releasing the bolt device from the inner part when the driving member is forced downwards. A locking member retains the driving member at its lower position and cooperates with the inner part in such a manner that the inner part releases the locking member from the driving member when the inner part moves upwards in relation to the outer part at the initial stage of the lift.

DESCRIPTION OF THE PREFERRED EMBODIMENT

Figure 3:
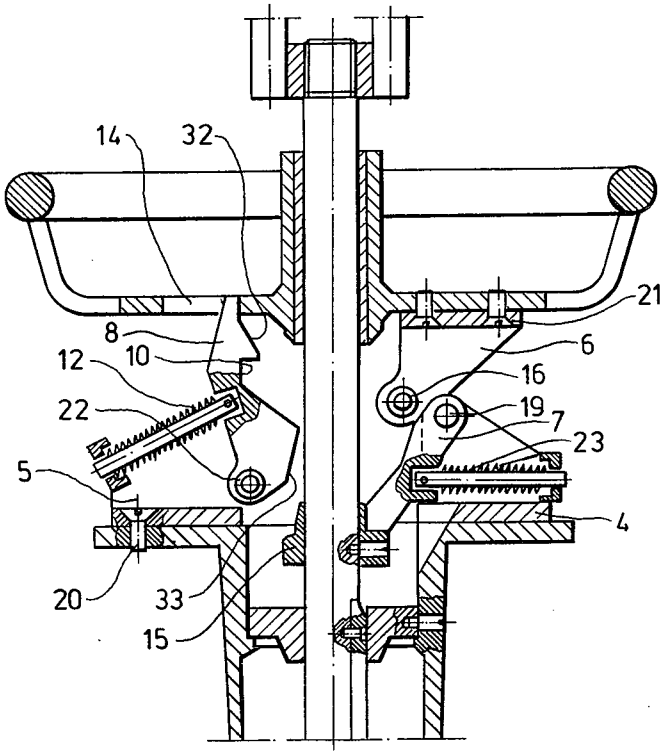
FIGS. 3, 4 and 5 show partial views of the section along line B—B in FIG. 2, the center lifting device being at different stage of operation.
Figure 2:
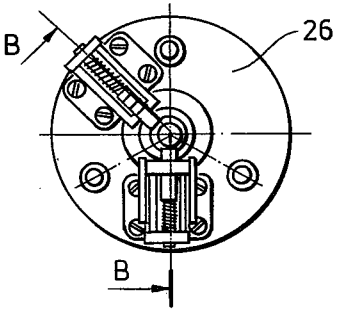
FIG. 2 shows a cross section along line A—A in FIG. 1.

As can be seen from the drawing, the center lifting device according to the invention comprises a tubular outer part or body 1, inside which there has been fitted coaxially a bar-like inner part or lifting shaft 3, which can be moved axially in the body 1. This axial movement is produced when the center lifting device is lifted by the lifting loop 9 attached to the upper end of the lifting shaft 3, whereby the lifting shaft 3 tends to rise in relation to the body 1. This movement between the body 1 and the lifting shaft 3 causes the gripping member 28 fitted to the lower end of the body 1 to expand and to grip the paper roll core socket inside which it has been lowered.

The gripping member 28 is preferably of the type known from U.S. Pat. No. 3,892,437, wherein the lower end of the body 1 forms a hydraulic, perforated cylinder covered with a resilient mantle. The lower end of the lifting shaft 3 has been attached to the piston of the cylinder in such a manner that, when rising, the piston forces liquid through the perforations, in the cylinder into the clearance between the cylinder and the mantle, whereby the mantle expands and grips the socket.

The load, i.e., the paper roll, remains in place until a state of equilibrium between its weight and the mantle liquid pressure has been reached. In order to reach this equilibrium, the body has preferably at least one downwards converging conical wall part 13, which has been dimensioned according to the socket of the roll to be lifted in such a manner that conical part 13 of the center lifting device fits tightly in the socket. Thus, by lifting to some extent the lifting shaft by the lifting loop 9 the lifting shaft can be caused to rise without the body 1 becoming detached from the roll, whereby the gripping member 28 expands and adheres tightly to the socket. Thereafter, as more lifting force is applied to the lifting loop 9, the center lifting device grips the socket all the more firmly.

Figure 1:
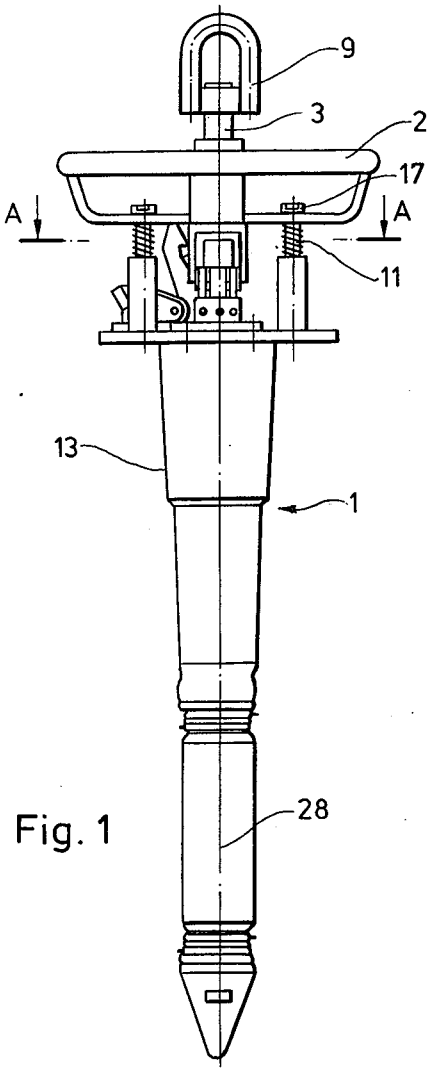
FIG. 1 shows a side view of a preferred embodiment of the invention.

The center lifting device shown in FIG. 1 is thus applicable to two socket sizes, although the gripping member 28 must usually be replaced when switching from one socket size to another.

The center lifting device according to the invention is semi-automatic, i.e., the detaching takes place automatically after the load has been lowered onto its base. The detaching is effected by a mechanism fitted at the upper end of the body 1; the detailed structure of this mechanism is shown in FIGS. 3–5.

Figure 4:
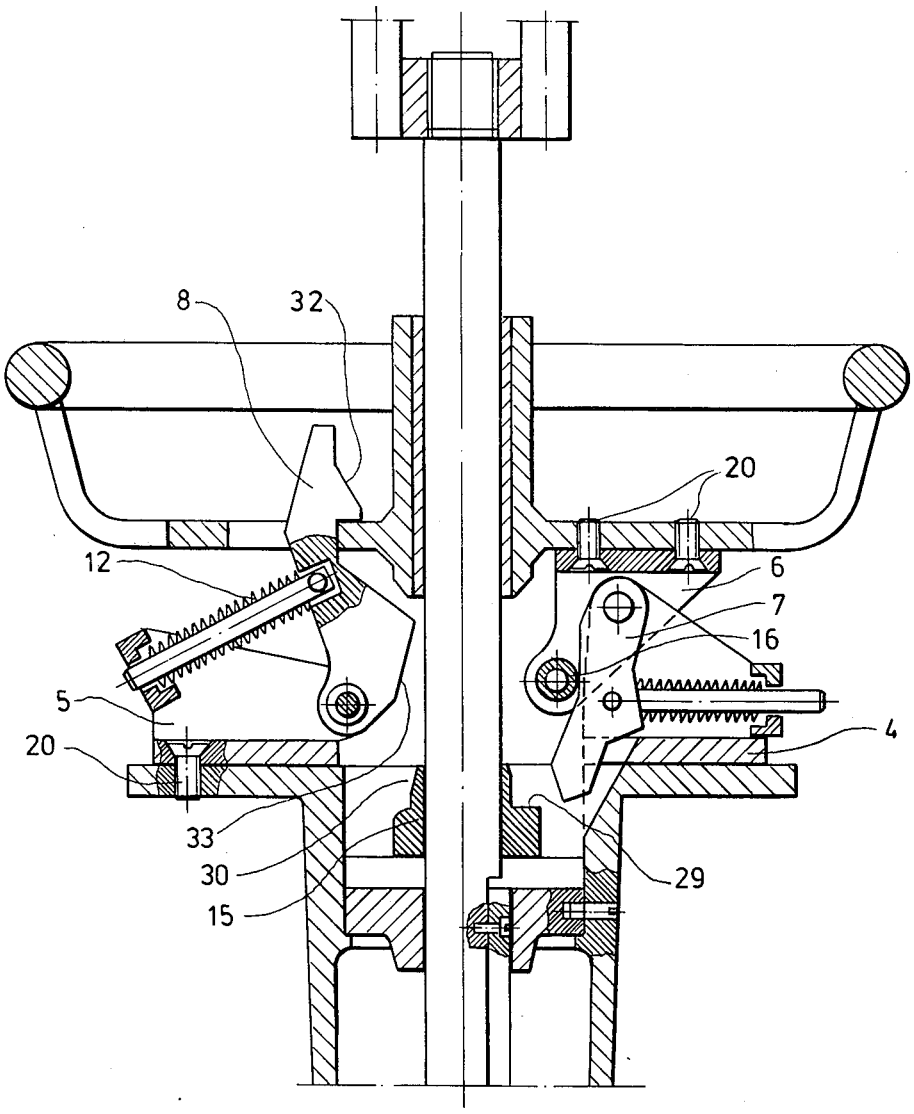
Figure 5:
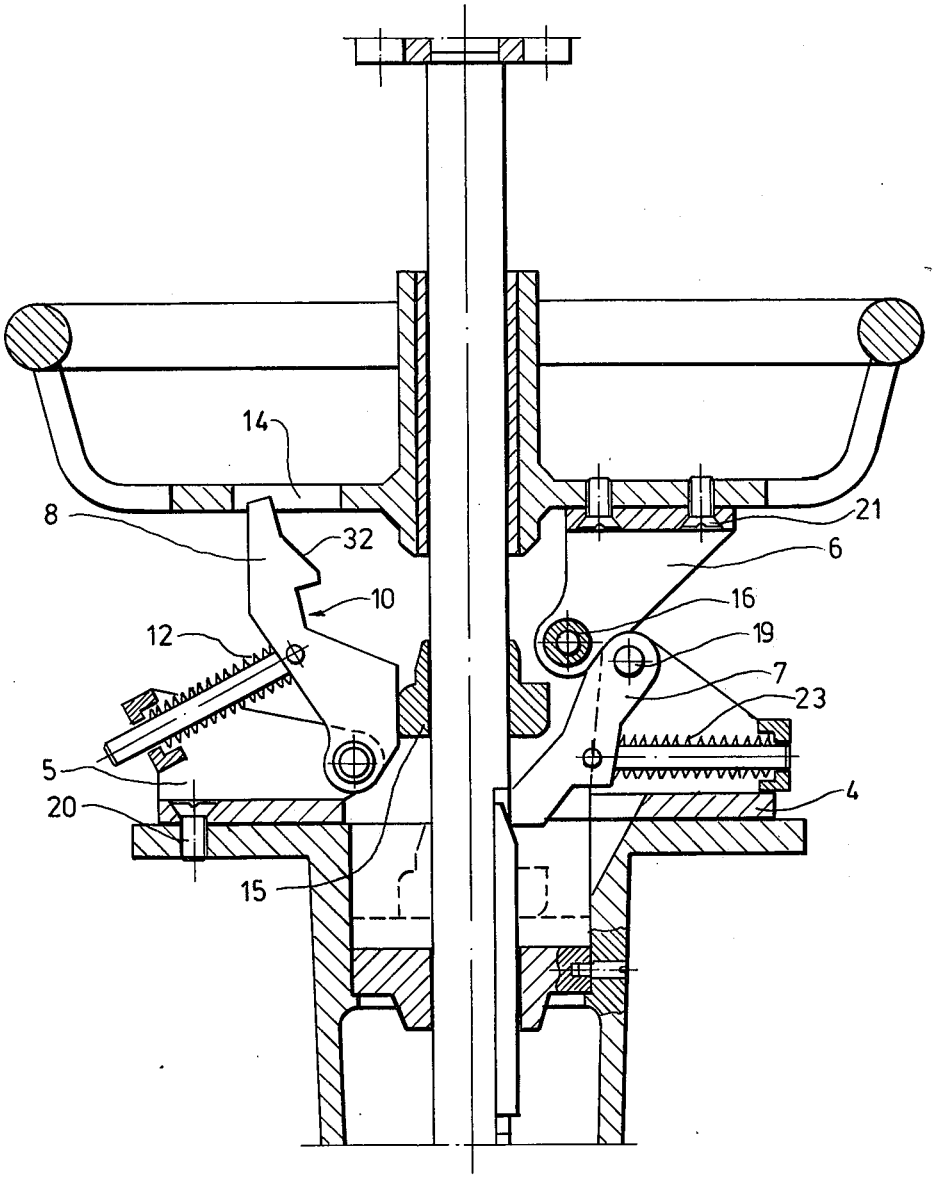

As can be seen from FIGS. 3–5, a base plate 26 is attached to the upper end of the body 1, and supports 4 and 5 are attached with screws 20 to the base plate 26.

To the support 4 there is attached a one-armed lever arm or switch lever 7 to pivot at its upper end around a substantially horizontal shaft journal 19; a spring 23 attached at one end to the support 4 forces the switch lever 7 to turn towards the lifting shaft 3.

The second support 5 has a second, hook-like, one-armed lever arm or release lever 8 which at its lower end pivots around a substantially horizontal shaft journal 22 and is fitted to turn towards the lifting shaft 3, forced by a spring 12 attached to the support 5 at one end. The release lever 8 is shaped in such a manner that in its edge facing the lifting shaft 3 there are in its upper part a guide surface 32 slanted downwards and directed towards the lifting shaft 3, in its lower part a second guide surface 33 slanted upwards and directed towards the lifting shaft 3, and between them a notched part 10.

On the lifting shaft 3, between the base plate 26 and the lifting loop 9, there is fitted a horizontally ring-like driving member or driving wheel 2 which slides axially along the lifting shaft; the driving wheel 2 is attached by means of guide bolts 17 to bear on springs 11 to the base plate 26 at the upper end of the frame 1 in such a manner that the driving wheel 2 can be forced downwards against the springs 11 and, when released, it automatically returns to its upper position. The driving wheel 2 also has an opening 14 in alignment with the release lever 8; the upper end of the release lever 8 extends to the opening 14.

To the lower side of the driving wheel 2 there has been attached, also by means of screws 21, a support 6, at the lower end of which there is a substantially horizontally directed roll 16 above the switch lever 7. The shaft of the roll 16 is substantially parallel to the journal pin 19 of the switch lever 7 and has been fitted to move along with the driving wheel 2 vertically between the journal pin 19 and the lifting shaft 3.

Furthermore, to the lifting shaft 3, at a suitable distance below the driving wheel 2, there is attached a shaft ring 15; on that side of the shaft ring 15 which faces the switch lever 7 there is an upwardly directed shoulder 29 and on that side which faces the release lever 8 there is an also upwardly directed stop surface 30, which can be caused to work in conjunction with the guide surface 33 of the release lever 8.

A center lifting device according to the invention is operated as follows: The device suspended by its lifting loop 9 is lowered into the hollow in the paper roll until it is supported on the roll by the conical part 13 of the body 1. The body has two such conical parts 13 for two different or care socket sizes. The body 1 and the mechanism is common to them both, but the hydraulic gripping member 28 which presses into the socket must be replaced for each socket size.

At this lowering stage the levers of the mechanism are in the position shown in FIG. 3. This is the position of the levers when the device hangs empty, i.e., without a load. The switch lever 7 is at the shoulder 29 of the shaft ring 15 and thereby supports the body 1 of the device and the gripping member 28 attached to its lower end. The piston has risen somewhat from its lower position. There is no liquid nor pressure in the rubber mantle yet.

The driving wheel 2 is pushed down. The conical part of the body 1 grips the socket in the paper roll more firmly. At the same time the driving wheel 2 presses downwards. When the lifting shaft 3 has thereby been pressed to its lower position, the roll 16 attached to the driving wheel releases the lever 7 from the shoulder 29 of the shaft ring 15. This stage is illustrated in FIG. 4. The lifting shaft 3 is disconnected from the outside body 1 and can rise upwards. When the driving wheel 2 presses downwards, the edge of the opening 14 pushes the release lever 8 away from the lifting shaft 3, and when the edge of the opening 14 has slid past the guide surface 32, the release lever 8 snaps onto the driving wheel 2, while the edge of the opening 14 comes into the notch 10 of the release lever 8. The driving wheel 2 stops at this lower position, retained by the release lever 8. The body 1 is in place and the conical part 13 provides the necessary retaining force at the initial stage of the lift.

The load is thereafter lifted as follows:

When the lifting begins, the piston rises in the cylinder and forces the liquid through the perforations in the upper part of the cylinder into the rubber mantle. The mantle expands in the clearance between the outer wall of the cylinder and the socket of the roll. The pressure in the mantle rises and the situation continues until an equilibrium has been reached between the pressure on the one hand and the moving of the shaft 3 due to the weight of the load on the other hand. These partial factors are interdependent in such a manner that when the load is heavier and thus the lifting force is greater, the pressure in the mantle rises higher. The pressure between the cylinder mantle and the wall of the roll socket couples the load to the lifting device and the roll can be lifted to be supported by the device. This takes place when the levers are in the position shown in FIG. 4.

When the lifting shaft 3 moves upwards at the pressing stage the stop 30 of the shaft ring 15 releases the release lever 8, which releases the driving wheel 2 to return to its upper position, aided by the springs 11. At the same time the roll 16 rises and releases the switch lever 7 from its grip. This position of the levers is illustrated in FIG. 5.

When the load has been lowered onto its base after the transfer, the lifting shaft 3 returns to its lower position. The pressure in the mantle lowers to zero, the mantle contracts to its initial size and detaches its grip from the core socket. The shaft ring 15 lowers below the switch lever 7. The levers are at this time in the position shown in FIG. 3 and the device is detached from the load.

What is claimed is:

1. A center lifting device for lifting and transferring rolls of material, such as papers rolls and the like having a hollow opening formed therein, comprising inner and outer parts arranged with said inner part located within said outer part and being movable inside the outer part over a limited distance in relation to each other, said outer part being adapted to be fitted partly into the hollow opening in the material roll to be lifted, said inner part having an upper end including means for attaching the inner part to be a lifting device, said outer part having a lower end including expandable and contractable means for selective gripping and releasing engagement with said hollow opening in response to relative movement of the parts and an upper end including means for selectively preventing said inner part from rising in relation to said outer part; a driving member, means for resiliently mounting said driving member on the upper end of said outer part for axial movement between upper and lower positions with respect to said upper end of the outer part and including means cooperating with said preventing means for releasing the preventing means when the driving member is forced downwards to permit said inner part to rise with respect to said outer part; and releasable locking means for retaining said driving member at its lower position adjacent the upper end of the outer part and cooperating with said inner part to release the lock means from the driving member when the inner part moves upwards in relation to the outer part at the initial stage of a lift.

2. A center lifting device according to claim 1 in which the upper part of the outer part is conical, the diameter of the lower end of the conical part is smaller and the diameter of the upper portion of said conical part being greater than the diameter of the hollow opening in the roll of the material to be lifted and transferred.

3. A center lifting device according to claim 2, in which the outer part has at least two conical parts, successive in the direction of the inner part, the conical part closest to the upper end of said outer part having a larger maximum diameter than the other conical part.

4. A center lifting device according to claim 1, in which said preventing means comprises a one-armed lever articulated at the upper end of said outer part about an axis transverse to the longitudinal axis of said inner part and spring means for biasing said one-armed lever towards said inner part; said inner part having a shoulder thereon positioned to engage said one-armed lever and prevent upward movement of said inner part with respect to said outer part.

5. A center lifting device according to claim 4, in which said releasing means comprises a roll mounted on said driving member and positioned to force said one-armed lever away from said inner part against the bias of said spring means when said driving member is pushed down towards the upper end portion of said outer part to its lower position.

6. A center lifting device according to claim 4 in which said inner part has a ring mounted thereon in which said shoulder is formed.

7. A center lifting device according to claim 1, in which the driving member is mounted on the upper end of the outer part, and said mounting means includes spring means for normally biasing the driving member into said upper position with respect to said upper end of the outer part.

8. A center lifting device according to claim 1, in which said locking means comprises a one-armed, hook-like lever arm, articulated about a substantially horizontal shaft at the upper end of said outer part and spring means for biasing said hook-like lever arm towards said inner part, said hook-like arm having an upper end including a guide surface for engaging a portion of said driving member when said driving member is forced downwards towards the upper end of the outer part to turn the lever arm against the effect of said spring means until the hook-like end snaps onto the driving member thereby locking it in its lower position adjacent the upper end of said outer part.

9. A center lifting device according to claim 8, in which said hook-like lever arm has a lower end on the side of said horizontal shaft opposite said upper end of the lever arm which includes a second guide surface, said inner part having a stop positioned to engage said second guide surface in order to force the lever arm to turn about said shaft so that the driving member is released and returns to its uppermost position.

10. A center lifting device according to claim 9, in which said inner part has a ring mounted thereon in which said stop is formed.

* * * * *